US007275743B2

(12) United States Patent
Mui et al.

(10) Patent No.: US 7,275,743 B2
(45) Date of Patent: Oct. 2, 2007

(54) MULTIFUNCTION OUTPUT TRAY FOR PRINTER AND PAPER HANDLING DEVICE

(75) Inventors: Paul K. Mui, Boise, ID (US); David J. Arcaro, Flagstaff, AZ (US); Roberto Obregon, Jalisco (MX); Russell A. Mendenhall, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 321 days.

(21) Appl. No.: 10/373,818

(22) Filed: Feb. 25, 2003

(65) Prior Publication Data

US 2004/0140611 A1 Jul. 22, 2004

Related U.S. Application Data

(63) Continuation-in-part of application No. 10/348,442, filed on Jan. 21, 2003, now Pat. No. 6,851,668.

(51) Int. Cl.
*B65H 31/00* (2006.01)

(52) U.S. Cl. ..... 271/207; 270/58.07; 399/405; 399/407

(58) Field of Classification Search ..... 270/58.09, 270/58.08, 58.11; 271/215, 217, 303, 298, 271/207, 184, 185, 186, 225, 278, 65; 399/405–410
See application file for complete search history.

(56) References Cited

U.S. PATENT DOCUMENTS 4,189,133 A * 2/1980 Arrasmith et al. ..... 271/215
4,905,055 A 2/1990 Higaki
5,033,731 A * 7/1991 Looney ..... 271/176
5,037,077 A * 8/1991 Kubota et al. ..... 270/58.12
5,201,517 A * 4/1993 Stemmle ..... 271/291
5,215,301 A * 6/1993 Oshino et al. ..... 271/212
5,320,336 A * 6/1994 Asami ..... 270/58.08
5,344,130 A * 9/1994 Suzuki et al. ..... 270/58.02
5,478,061 A * 12/1995 Murakami et al. ..... 270/58.08
5,709,376 A * 1/1998 Ushirogata ..... 270/58.11
5,823,529 A * 10/1998 Mandel et al. ..... 271/296
5,963,754 A * 10/1999 Itoh et al. ..... 399/21
6,109,606 A * 8/2000 Johnson et al. ..... 271/213
6,237,910 B1 * 5/2001 Kawata ..... 271/213
6,308,952 B1 10/2001 Takagi et al.

(Continued)

FOREIGN PATENT DOCUMENTS

EP 1151949 A1 * 11/2001

*Primary Examiner*—Patrick Mackey
*Assistant Examiner*—Jeremy R Severson

(57) ABSTRACT

A representative embodiment provides for an imaging apparatus including an output tray supported by the imaging apparatus and configured to receive sheet media from a first source and a second source, wherein the first source and the second source are respectively supported by the imaging apparatus. Optionally, the imaging apparatus also includes a detector configured to provide a signal in response to a predetermined accumulation of sheet media from the first source and the second source within the output tray. Another embodiment provides a method of receiving a first sheet media and a second sheet media within a common output tray, including routing the first sheet media from an imaging device into the output tray using a diverter device, and routing the second sheet media from the imaging device into a sheet handling device and then into the output tray using the diverter device.

28 Claims, 7 Drawing Sheets

U.S. PATENT DOCUMENTS 6,332,606 B1 * 12/2001 Seki ..... 270/59
6,375,180 B1 * 4/2002 Kawano et al. ..... 270/58.09
6,408,147 B1 * 6/2002 Oshida ..... 399/82
6,443,449 B1 9/2002 Takagi et al.
6,599,226 B2 * 7/2003 Asai et al. ..... 493/321
6,705,603 B1 * 3/2004 Kirino et al. ..... 270/12
2001/0052666 A1 * 12/2001 Kuwata et al. ..... 271/3.01

* cited by examiner

MULTIFUNCTION OUTPUT TRAY FOR PRINTER AND PAPER HANDLING DEVICE

CROSS REFERENCE TO RELATED APPLICATIONS

This application is a continuation-in-part of U.S. patent application Ser. No. 10/348,442, filed Jan. 21, 2003 now U.S. Pat. No. 6,851,668.

BACKGROUND

The combining of an imaging device with a sheet-handling device, thus forming a unitary imaging apparatus, is known. Typically, the imaging device is in the form of a printer or copier, or any other device that forms images on sheet media, such as paper. Furthermore, the sheet handling device that is typically combined (i.e., incorporated) with such an imaging device generally has one or more sheet handling functions, such as, for example, stapling, collating, sheet folding, or hole punching.

Some types of unitary imaging apparatus further include some other kind of device for use with sheet media, such as a scanner. One possible example of a unitary imaging apparatus can include a laser printer, a sheet-handling device, and a copier/scanner incorporated as a single unit. Such unitary imaging apparatus are sometimes generally referred to as multifunction or all-in-one machines. Other examples of unitary imaging apparatus are possible.

While the relatively broad range of functions provided by a typical unitary imaging apparatus is generally desirable to some users, the size and orientation of features on such an apparatus can contribute to usage difficulties on the part of some persons. For example, when some particular unitary imaging apparatus is located on a desk or table top, within, say, an office or other multi-user environment, the reach required for a given person to access the uppermost features of the apparatus can make usage generally difficult or otherwise undesirable. In another exemplary situation, a given user can lack the physical stature to utilize some or all of the controls on a similarly located unitary imaging apparatus.

Therefore, it is desirable to provide a unitary imaging apparatus that avoids the usage difficulties described above.

SUMMARY

One embodiment provides an imaging apparatus, including an output tray supported by the imaging apparatus and configured to receive first sheet media from a first source and to receive second sheet media from a second source, wherein the first source and the second source are respectively supported by the imaging apparatus.

Another embodiment provides an imaging apparatus, including an imaging device configured to generate images on sheet media, and a sheet handling device configured to receive sheet media from the imaging device. The imaging apparatus further includes an output tray configured to receive sheet media from both of the imaging device and the sheet handling device.

Yet another embodiment provides a multi-function printer, including a controller optionally including a processor, and an imaging device coupled in control signal communication with the controller and configured to selectively generate images on sheet media. Further included are a sheet handling device coupled in control signal communication with the controller and configured to selectively perform at least one operation on sheet media received from the imaging device, and an output tray configured to receive sheet media from the imaging device and sheet media from the sheet handling device. The multi-function printer also includes a level detector configured to provide a level signal to the controller in response to detecting a predetermined accumulation of the sheet media from the imaging device and the sheet media from the sheet handling device within the output tray.

Still another embodiment provides a method of receiving a first sheet media and a second sheet media within a common output tray, including routing the first sheet media from an imaging device into the output tray using a diverter device, and routing the second sheet media from the imaging device into a sheet handling device and then into the output tray using the diverter device.

These and other aspects and embodiments will now be described in detail with reference to the accompanying drawings, wherein:

DETAILED DESCRIPTION

In representative embodiments, the present teachings provide methods and apparatus for a unitary imaging apparatus that avoids the usage difficulties discussed above.

Figure 1:
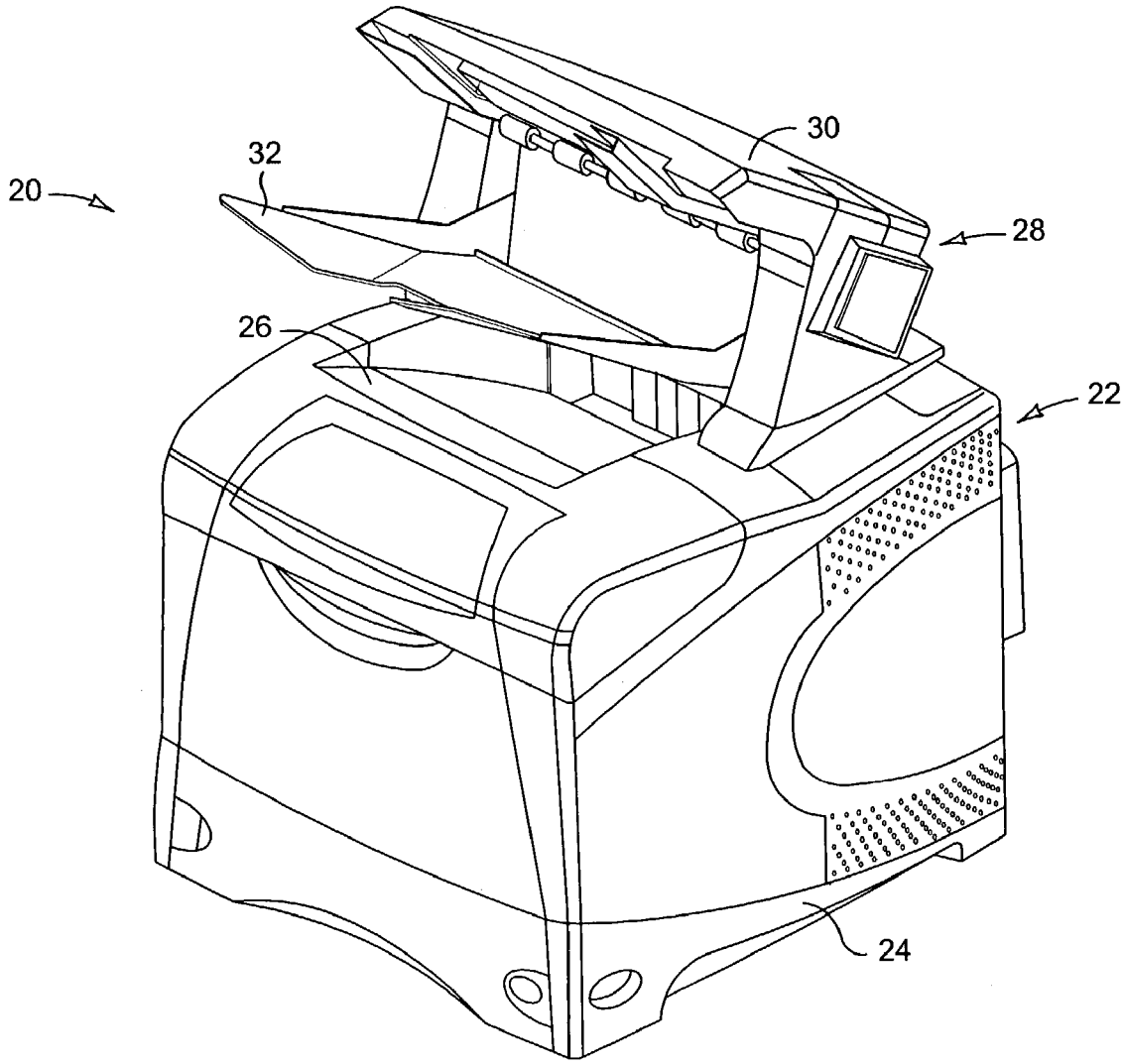
FIG. 1 (Prior Art)
FIG. 1 is a perspective view depicting a unitary imaging apparatus in accordance with one example of the prior art.

FIG. 1 is a perspective view depicting a unitary imaging apparatus 20 in accordance with the prior art. The unitary imaging apparatus 20 includes a printer 22. The printer 22 as shown is a laser printer, but other kinds of printer such as, for example, ink jet, thermal paper, or dot matrix can- be used. The printer 22 includes a printer housing 24, which is configured to generally house and support a plurality of components (not shown) that are inherent to the printer 22. It can be appreciated by those of skill in the art that the components (not shown) inherent to the printer 22 are known and required for typical operation thereof, and that further elaboration of these components is not required for purposes herein.

The printer 22 of the imaging apparatus 20 further includes a printer output tray 26. The printer output tray 26 is supported by, and generally made integral with, the housing 24 of the printer 22. The printer output tray 26 is configured to receive sheet media (not shown) from the components (not shown) of the printer 22.

The unitary imaging apparatus 20 further includes a sheet-handling device 28. The sheet-handling device 28 includes a handler housing 30, which is configured to generally house and support a plurality of other components (not shown), which are inherent to the sheet-handling device 28. For example, such sheet handling components (not shown) can include, but are not limited to, a stapler, a collator, a folder, or a hole punch. Other kinds of components for use with the sheet-handling device 28 are possible. The sheet-handling device 28 further includes a handler output tray 32 that is supported by the handler housing 30 and configured to receive sheet media (not shown) from the components (not shown) of the sheet-handling device 28.

Operation of the unitary imaging device 20 is generally conducted as follows: The printer 22 receives print job data representing an imaging task (i.e., a document or documents to be printed and optionally handled) by way of a user computer (not shown) coupled to the unitary imaging device 20. The printer 22 forms images on sheet media (not shown) corresponding to the data, and selectively transports the printed sheet media (not shown) into the printer output tray 26, or into the sheet-handling device 28, in accordance with the print job data.

In a case in which the print job data does not call for any post-imaging operations to be performed by the sheet-handling device 28, the printer 22 simply discharges the printed sheet media (not shown) directly to the printer output tray 26.

In another case, in which the print job data received by the printer 22 does request one or more post-imaging operations to be performed by the sheet handling device 28 (such as, for example, stapling individual sheet media together as a single document), the printer 22 transports and guides the printed sheet media (not shown) into the sheet handling device 28, where the data-requested sheet handling operations (e.g., stapling) are performed. Upon completion of the sheet handling operation or operations, the sheet handling device 28 discharges the printed and handled sheet media (not shown) into the handler output tray 32.

The unitary imaging apparatus 20 is typically located for operation on a desk or counter top (not shown). As such, a user is required to have sufficient reach so as to retrieve sheet media from either or both of the printer output tray 26 and the handler output tray 32, in accordance with the situation at hand. For some persons, this reach requirement is not readily attained, particularly in the case of accessing the handler output tray 32, to the extent that some individuals must resort to using a stepstool or other assistance so as to retrieve sheet media there from. The situation is exacerbated for persons in wheelchairs or having mobility handicaps.

Figure 2:
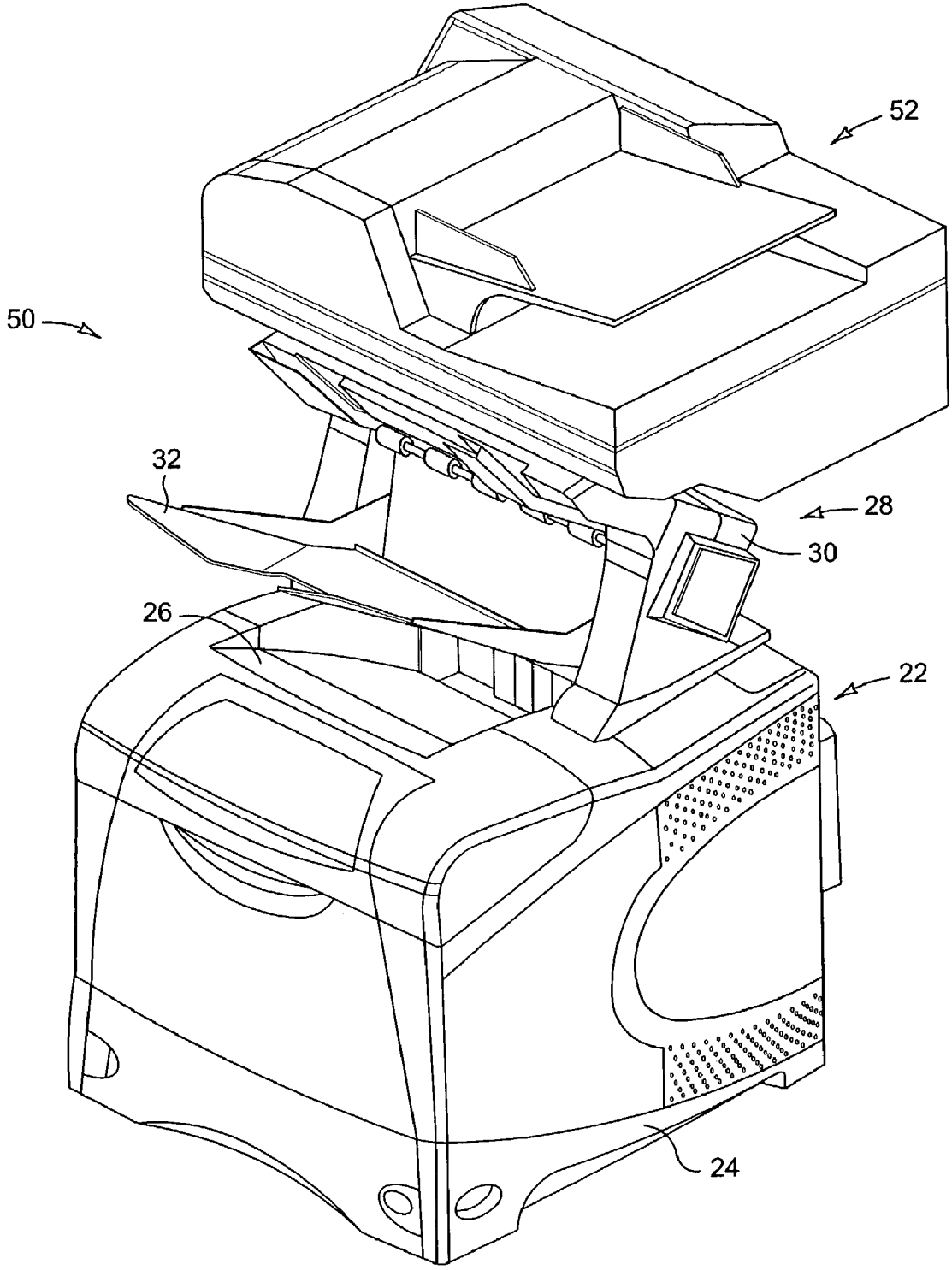
FIG. 2 (Prior Art)
FIG. 2 is a perspective view depicting a unitary imaging apparatus in accordance with another example of the prior art.

FIG. 2 is a perspective view depicting a unitary imaging apparatus 50 in accordance with another example of the prior art. The unitary imaging device 50 includes a printer 22, printer housing 24, printer output tray 26, sheet handling device 28, handler housing 30, and a handler output tray 32 which retain substantially all of the elements, features and cooperative performance described above for the like numbered elements of the unitary imaging device 20 of FIG. 1. The unitary imaging apparatus 50 further includes a scanner 52. The scanner 52 is generally coupled to and supported by the housing 24 of the printer 22, by way of the housing 30 of the sheet-handling device 28.

Operation of the unitary imaging apparatus 50 is performed substantially as described above for the unitary imaging apparatus 20. Additionally, the scanner 52 of the apparatus 50 can be used to derive scanned data representing the image content of scanned sheet media (not shown). This scanned data can then be used for other imaging purposes, such as, for example, producing copies of the scanned sheet media using the printer 22, incorporating the scanned data within a document file stored in a computer (not shown) coupled to the imaging apparatus 50, etc.

Certain typical operations of the unitary imaging apparatus 50 require a user to, for example, place sheet media (not shown) on, or remove sheet media from, the scanner 52. The execution of these and other operations further require that a user possess, or otherwise exercise, sufficient reach to access the scanner 52. As the scanner 52 is located generally over the sheet-handling device 28, and away from the customary side of approach to the unitary imaging apparatus 50, the reach required in using the scanner 52 can be undesirably burdensome, or nearly impossible, for some persons to achieve. Furthermore, the required reach to the scanner 52 or other aspects of the unitary imaging apparatus 50 (such as, for example, the handler output tray 32) can be made even more troublesome as a result of the location of use, or other factors.

Therefore, it is desirable to provide a unitary imaging apparatus that avoids the undesirable reach and access problems described above. Embodiments of the present invention provide for respective unitary imaging apparatuses that include a single media output tray, which is configured to receive sheet media discharged from two different sources such as, for example, a printer and a sheet-handling device. Through the use of a single media output tray, and an optional media level detector associated with the cumulative discharge of sheet media into the output tray from two different sources, embodiments of the present invention are generally reduced in overall physical size, relative to typical unitary imaging apparatuses of the prior art, thereby reducing the reach requirement imposed upon a user during typical operation. Such embodiments of the present invention are described hereafter.

Figure 3:
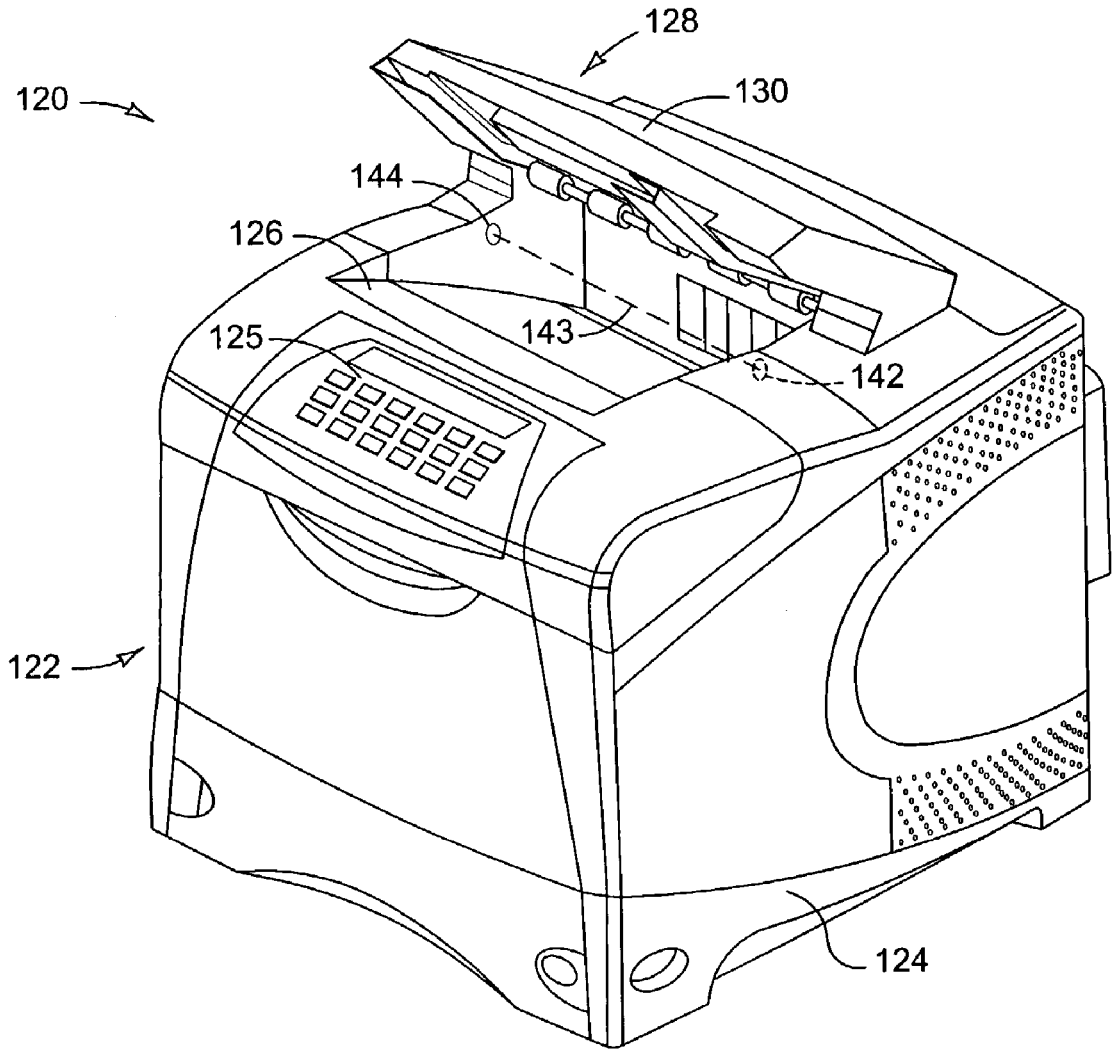
FIG. 3 is a perspective view depicting a unitary imaging apparatus in accordance with one embodiment of the present invention.

FIG. 3 is a perspective view depicting a unitary imaging apparatus 120 in accordance with an embodiment of the present invention. The unitary imaging apparatus 120 includes a printer 122. As shown, the printer 122 is a laser printer; however, it is to be understood that any suitable printer can be used, such as, for example, an ink jet printer, a thermal-paper printer, a dot matrix printer, etc. Generally, most kinds of printers can be used within the scope of the invention. The printer 122 is configured to form images on sheet media (not shown), in accordance with print job data received (typically) from a computer (not shown) coupled to the unitary imaging apparatus 120.

The printer 122 includes a housing 124. The housing 124 is configured to house and support a plurality of printer components inherent to the printer 122. A portion of these components shall be described in detail hereafter, as required for an understanding of the invention. The printer 122 further includes an output tray 126. The output tray 126 is supported by, and generally made integral with, the housing 124 of the printer 122. The output tray 126 is configured to receive sheet media (not shown) from the printer 122 and a sheet-handling device 128, described hereafter. The printer 122 further includes a user interface (i.e., control panel) 125, supported by the housing 124. The control panel 125 is configured to provide various status indications to, and to accept operating instructions from, a user in accordance with typical operation of the unitary imaging apparatus 120.

The unitary imaging apparatus 120 further includes a sheet-handling device 128. The sheet-handling device 128 includes a handler housing 130. The handler housing 130 is configured to house and support a plurality of handler components (not shown in FIG. 3) inherent to the sheet-handling device 128. Non-limiting examples of such handler components can include a stapler, a collator, a folder, a binder, or a hole punch. Other handler components can be used in conjunction with the sheet-handling device 128. The sheet-handling device 128 is support by the printer housing 124, and is generally disposed in overlying adjacency to the output tray 126. The sheet-handling device 128 is configured to receive printed sheet media (not shown) from the printer 122, to perform one or more handling operations on the received sheet media in accordance with the print job, and to discharge the handled sheet media to the output tray 126.

The printer 122 of the imaging apparatus 120 further includes a light source 142 and a light sensor 144, which are supported by the printer housing 124. The light source 142 and light sensor 144 will be described hereafter in conjunction with other elements and the operation of the imaging apparatus 120, and are noted here for purposes of understanding their respective orientations within the imaging apparatus 120.

Figure 4:
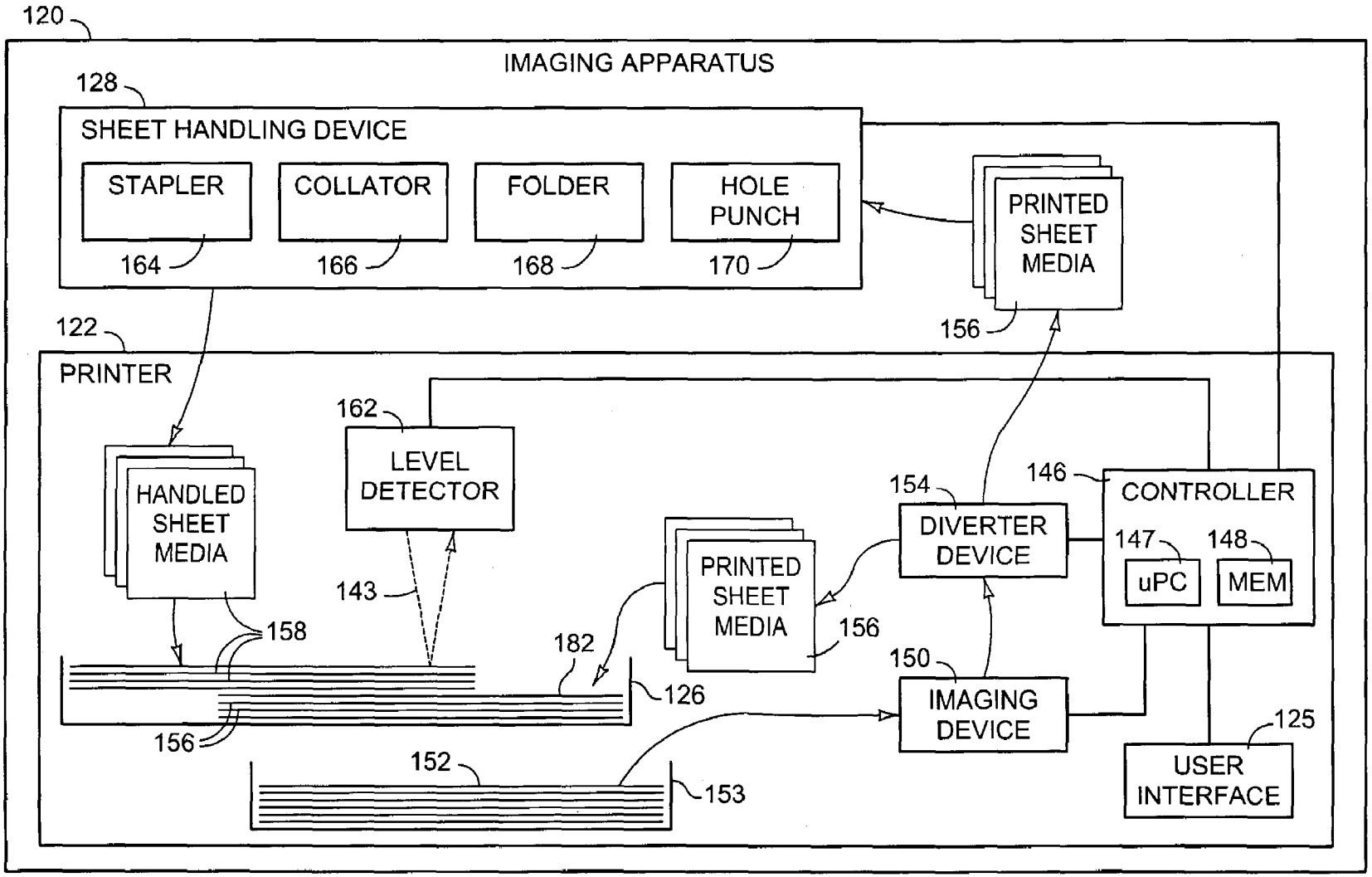
FIG. 4 is a block diagrammatic view depicting typical cooperative elements in accordance with the embodiment of FIG. 3.

FIG. 4 is a block diagrammatic view depicting a cooperative arrangement of elements typical to the unitary imaging apparatus 120 of FIG. 3. The unitary imaging apparatus 120 includes a controller 146 within the printer 122. As shown, the controller 146 includes a microprocessor 147 and a computer-readable memory 148. Other forms of controllers, in accordance with other embodiments of imaging apparatus 120, are also possible. In one embodiment, the memory 148 of the controller 146 stores a program code (not shown) that is configured to cause the processor 147 of the controller 146 to carryout various normal operations of the imaging apparatus 120. Such a program code (not shown) is also configured to cause the processor 147 to resumably suspend various normal operations of the imaging apparatus 120. In any case, the controller 146 is configured to control and/or suspend the various normal operations of the unitary imaging apparatus 120 as described in detail hereafter.

The unitary imaging apparatus 120 also includes the user interface 125, which is in signal communication with the controller 146. The user interface 125 can provide indications to a user (e.g., audible alert and/or visual signals), as well as accept user instructions regarding operations of the unitary imaging apparatus 120. Non-limiting examples of such audible and/or visual user indications can include indications of paperjam, full tray, empty sheet media tray or other resource, etc. Non-limiting examples of user instructions can include number-of-copies, sheet media source selection, sheet handling, resume normal operation after suspended operation, etc.

The printer 122 further includes an imaging device 150, which is in signal communication with the controller 146 and configured to form images on (typically) blank sheet media 152, thus producing printed sheet media 156. It is to be understood that the imaging apparatus 120 includes components that provide the imaging apparatus 120 with the ability to transport and route sheet media 152 and 156 within the printer 122 and the sheet-handling device 128, as required for normal operation, as will be well understood by one of skill in the art. The printer 122 further includes a diverter device 154. The diverter device 154 is in signal communication with the controller 146 and is configured to receive the printed sheet media 156 from the imaging device 150. The diverter device 154 is further configured to selectively route the printed sheet media 156 to the output tray 126, or to route the printed sheet media 156 to the sheet-handling device 128 of the unitary imaging device 120, under the control of the controller 146.

The printer 122 includes a level detector 162 that is coupled to the controller 146. The level detector 162 is configured to detect a predetermined accumulation (i.e., quantity, or level) of the printed sheet media 156 and a handled sheet media 158 (described hereafter) within the output tray 126, and to provide a signal to the controller 146 corresponding to the detection.

The sheet-handling device 128 of the unitary imaging apparatus 120 is in signal communication with the controller 146, and is controlled thereby. The sheet-handling device 128 can include one or more of a stapler 164, a collator 166, a folder 168, and a hole punch 170. Other functional devices in accordance with other embodiments of sheet handling device (not shown) can also be provided. The sheet-handling device 128 is configured to receive the printed sheet media 156 from the diverter 154, to perform one or more operations on the sheet media 156, using one or more of the devices 164170, resulting in the handled sheet media 158. The sheet-handling device 128 is further configured to discharge the handled sheet media 158 into the output tray 126 of the printer 122.

In normal operation, the unitary imaging apparatus 120 performs as follows: The unitary imaging apparatus 120 receives print job data from a computer (not shown) or another source that is in signal communication with the controller 146 of the printer 122. The imaging apparatus 120 draws (typically) blank sheet media 152 from a holding tray 153 and routes it to the imaging device 150. The imaging device 150 forms images (i.e., prints indicia) on the sheet media 152 in correspondence to the received print job data, resulting in the printed sheet media 156. The printed sheet media 156 is then routed from the imaging device 150 to the diverter device 154.

The diverter device 154 then routes the printed sheet media 156 to one of the output tray 126, or to the sheet-handling device 128, in accordance with the print job data received by the controller 146. If the print job data does not require any operations to be performed by the sheet-handling device 128, then the printed sheet media 156 is routed to (i.e., accumulates within) the output tray 126. If, however, the print job data calls for one or more sheet handling operations to be performed on the printed media 156 (i.e., stapling, hole punching, etc.), the printed sheet media 156 is routed to the sheet-handling device 128 via corresponding passageways and mechanisms (not shown).

Assuming that the print job data does call for sheet handling, the sheet-handling device 128 receives the printed sheet media 156 from the diverter 154. The sheet handling device 128 then performs one or more handling operations on the printed sheet media 156 in accordance with the print job data, using the stapler 164, collator 166, folder 168, and/or hole punch 170, as needed. The resulting handled sheet media 158 is then discharged into the output tray 126 by the sheet-handling device 128.

It is noted that the imaging apparatus 120 makes use of the single output tray 126 to receive both the printed sheet media 156 and the handled sheet media 158. In this way, the sheet-handling device 128 does not include an associated (i.e., handler) output tray, in contrast to the prior art handler output tray 32 of the imaging apparatus 20 of FIG. 1. Therefore, an operator need only have sufficient reach to access the output tray 126 of the unitary imaging apparatus 120, to carry out normally associated operations.

The unitary imaging apparatus 120 further provides for a generally more compact housing arrangement (i.e., combined size of the housings 124 and 130 of FIG. 3), thus enabling the imaging apparatus 120 to support another sheet media manipulation device, such as, for example, a scanner (not shown, but similar to scanner 52 of FIG. 2), with a reduction in the required user reach relative to that associated with the prior art described above.

Figure 5:
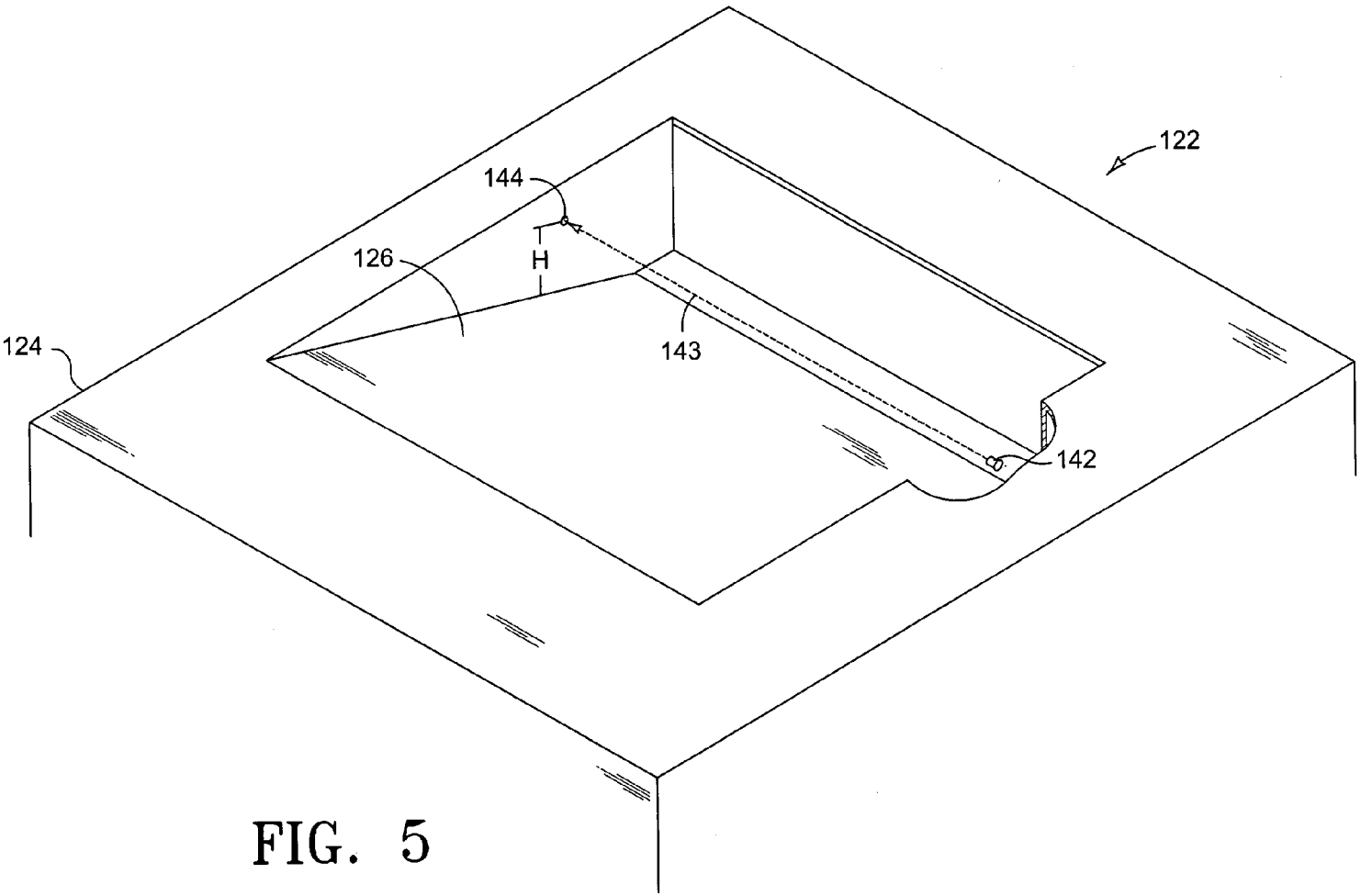
FIG. 5 is a perspective cutaway view depicting selected elements in accordance with the embodiment of FIG. 3.

FIG. 5 is perspective cutaway view of selected elements of the printer 122 of the unitary imaging apparatus 120. The printer 122 includes the light source 142 and the light sensor 144, as introduced above. The light source 142 and light sensor 144 are supported by the printer housing 124, in cooperative relation to each other on opposite sides of the output tray 126. The light source 142 and light sensor 144 are both elements common to the level detector 162, described above. The light source 142 is configured to emit a light beam 143 to the light sensor 144 that generally spans the width of the output tray 126. Furthermore, the light source 142 and the light sensor 144 are supported at a common height H, which generally defines a predetermined "full" level for the accumulated printed sheet media 156 and the handled sheet media 158 (not shown in FIG. 5, respectively) within the output tray 126.

Concurrent reference is now made to FIGS. 4 and 5. During typical operation of the unitary imaging apparatus 120, the printed sheet media 156 passes from the imaging device 150 to the output tray 126.

If the level of the printed sheet media 156 increases to the associated predetermined "full" level (i.e., as defined by height H) within the output tray 126, the level detector 162 responds to the blockage of the first light beam 143 by providing a "full" level signal to the controller 146.

The controller 146 can then take one or more predetermined actions in response to the level signal, such as, for example, temporarily (i.e., resetably, or resumably) suspending the normal operation of the imaging device 150, until such time as the predetermined level of printed sheet media 156 is cleared (i.e., removed) from the output tray 126, and/or a resume instruction is received via the user interface 125. Other actions on the part of the controller 146 can also be provided, such as providing an audio and/or visual alert to an operator regarding the full condition of the output tray 126, via the user interface 125 or other suitable means.

Under such a cleared condition of the output tray 126, the light beam 143 spans the width of the output tray 126 and is detected by the light sensor 144, and the level detector 162 removes or otherwise negates the level signal being sent to the controller 146. Normal operation of the imaging device 150 is then typically resumed by the controller 146.

Also, during typical operation, the handled sheet media 158 arrives in the output tray 126 from the sheet-handling device 128. If the handled sheet media 158 accumulates in the output tray 126 to the extent that the predetermined "full" level defined by the height H is reached, then the light beam 143 is substantially obscured, or blocked, from reaching the light sensor 144. The level detector 162 responds to the blockage of the light beam 143 by providing a "full" level signal to the controller 146. Thus, operation of the level detector 162 in conjunction with the handled sheet media 158 is substantially as described above in regard to the printed sheet media 156.

The controller 146 can then take one or more predetermined actions, such as, for example, temporarily (i.e., resumably) suspending the normal operation of the sheet handling device 128, until such time as the predetermined level of handled sheet media 158 is cleared (i.e., removed) from the output tray 126. Other actions on the part of the controller 146 are also possible, such as providing an audio and/or visual alert to an operator regarding the full condition of the output tray 126. Other actions on the part of the controller 146 can also be provided, such as providing operator alert indications regarding the "full" state of the output tray 126. Once the output tray 126 is returned to a cleared condition, the light beam 143 is again detected by the sensor 144. In response, the level detector 162 removes or otherwise negates the level signal sent to the controller 146, and normal operation of the sheet handling device 128 is typically resumed by the controller 146.

Furthermore, the operation of the level detector 162 is substantially the same as described above when an accumulation of both the printed sheet media 156 and the handled sheet media 158 results in the blockage of the light beam 143. Therefore, any ratio of printed sheet media 156 to handled sheet media 158, in sufficient accumulation to block the light beam 143 of the level detector 162, results in the provision of the level ("full") signal from the level detector 162 to the controller 146.

Figure 6:
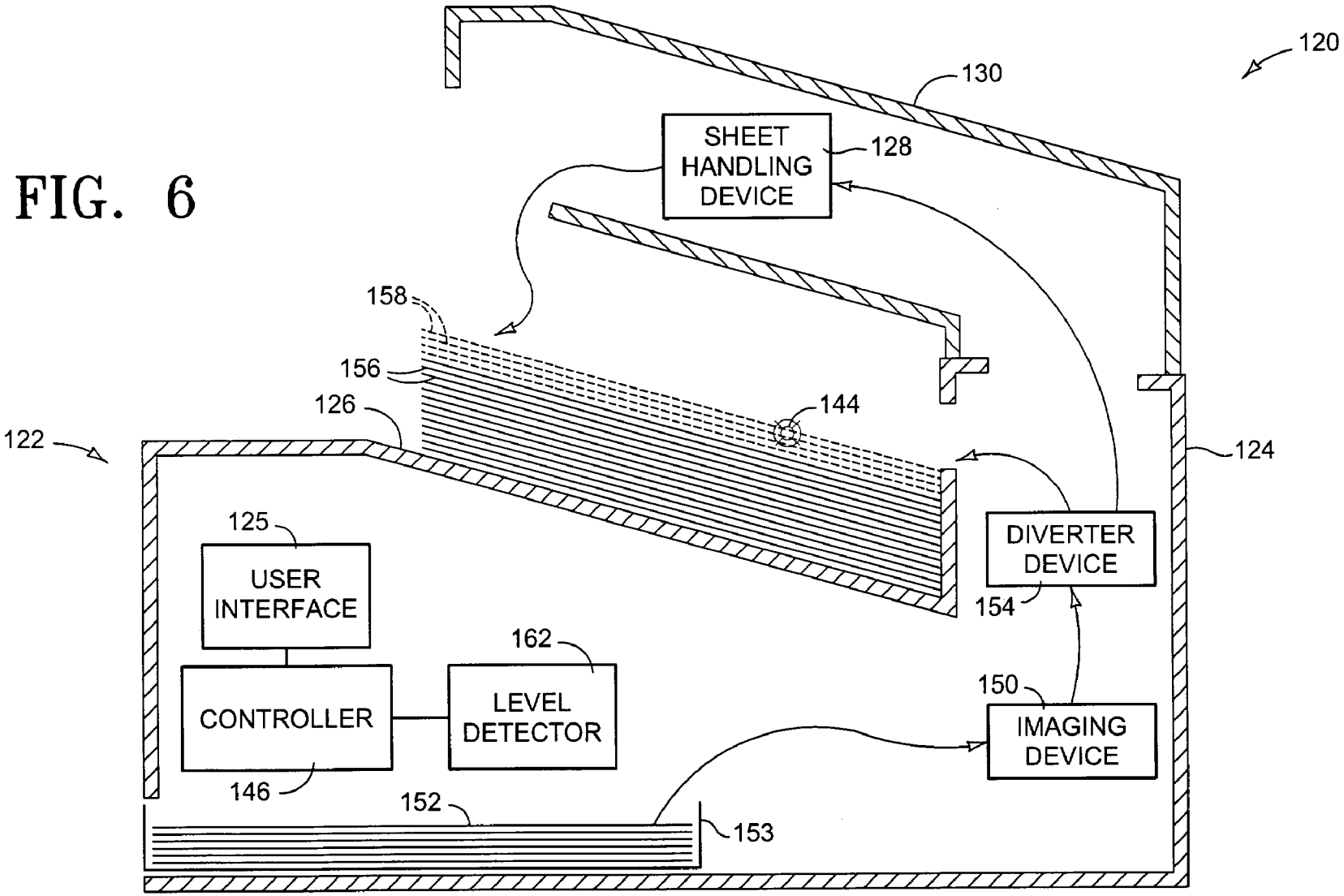
FIG. 6 is a side elevation schematic diagram depicting selected elements in accordance with the embodiment of FIG. 3.

FIG. 6 is a side elevation schematic diagram depicting a typical arrangement of selected elements (described above) of the unitary imaging apparatus 120. FIG. 6 is included to further clarify the typical arrangement and operation of the present invention, as embodied by the unitary imaging apparatus 120. In the scope of FIG. 6, it is to be understood that the user interface 125, the sheet-handling device 128, the imaging device 150, the diverter 154, and the level detector 162 are each in signal communication with the controller 146 as required to carry out normal operation of the unitary imaging apparatus 120. Furthermore, the light sensor 144 is in signal communication with the balance of the level detector 162.

As shown in FIG. 6, the printer 122 of the imaging apparatus 120 generally underlies and supports the sheet handler housing 130, which includes the sheet-handling device 128 therein. The light sensor 144 is shown as typically disposed, so as to define and detect the predetermined accumulation ("full" level) of the printed sheet media 156 and the handled sheet media 158 within the output tray 126.

Within the context of FIGS. 3 through 6, it will be appreciated that the light source 142 and the light sensor 144 cooperatively define the sensing elements of the level detector 162, and that other types of level detectors can be used. For example, the light source 142 and the light sensor 144 can be replaced with a spring-loaded actuator (not shown) placed in the output tray 126, such that when a predetermined accumulation (i.e., mass) of sheet media 156 and/or handled sheet media 158 occurs in the output tray, the actuator will open or close a switch. Furthering this example, the switch can be placed in signal communication with the controller (146 of FIG. 4) such that when the predetermined accumulation is reached, the operation of the imaging device 150 and/or the handing device 128 can be disabled, and/or the user notified of the "bin full" condition by way of the user interface 125 (FIG. 3). In general, the level detector 162 is configured to generally detect a predetermined "bin-full" condition in the output tray 126, and to provide a signal indication of such condition to the controller 146.

In an alternative embodiment of the present invention (not shown), an imaging apparatus is provided that is substantially defined, configured, and cooperative as described above in regard to the imaging apparatus 120 of FIGS. 3-6. However, this alternative embodiment does not include the level detector 162 or its associated light source 142, light beam 143, or light sensor 144. Thus, an imaging apparatus (not shown) in accordance with this alternative embodiment uses of a single output tray to receive sheet media from two different sources (e.g., a printer and a sheet handling device), without the use of a level detector 162 or the corresponding operations associated therewith. Such an imaging apparatus (not shown) provides satisfactory performance during usage that typically does not fill the output tray to the "full" level prior to being cleared (emptied) by a user. Furthermore, an imaging apparatus (not shown) in accordance with this alternative embodiment includes the generally compact design and reduced reach requirements substantially as described above in regard to the imaging apparatus 120 of FIGS. 3-6.

Therefore, an improved unitary imaging apparatus is provided by the present invention. The unitary imaging apparatus of the present invention can be generically described as including a number of sheet media level detectors corresponding to a number of different sources that discharge sheet media into a common output tray. Each level detector is configured to provide a signal in response to a predetermined or "full" level of the associated sheet media within the common output tray. Furthermore, the invention provides that a controller can make use of the respective level signals to selectively suspend various operations of the imaging apparatus, alert a user to a full output tray condition, or to initiate and/or suspend other functions as desired.

The controller 146 of FIG. 4 can include a processor (such as a microprocessor), or it can be configured solely from state circuit devices, or it can be a combination thereof. When the controller includes a processor, then the computer readable memory device 148 can contain a set of computer executable instructions to perform the acts described above with respect to disabling the imaging device 150 and/or the sheet handling device 128, and notifying a user via the user interface 125. One example of a logic program that can be provided within the controller 146 is depicted in the flowchart 200 of FIG. 7.

Figure 7:
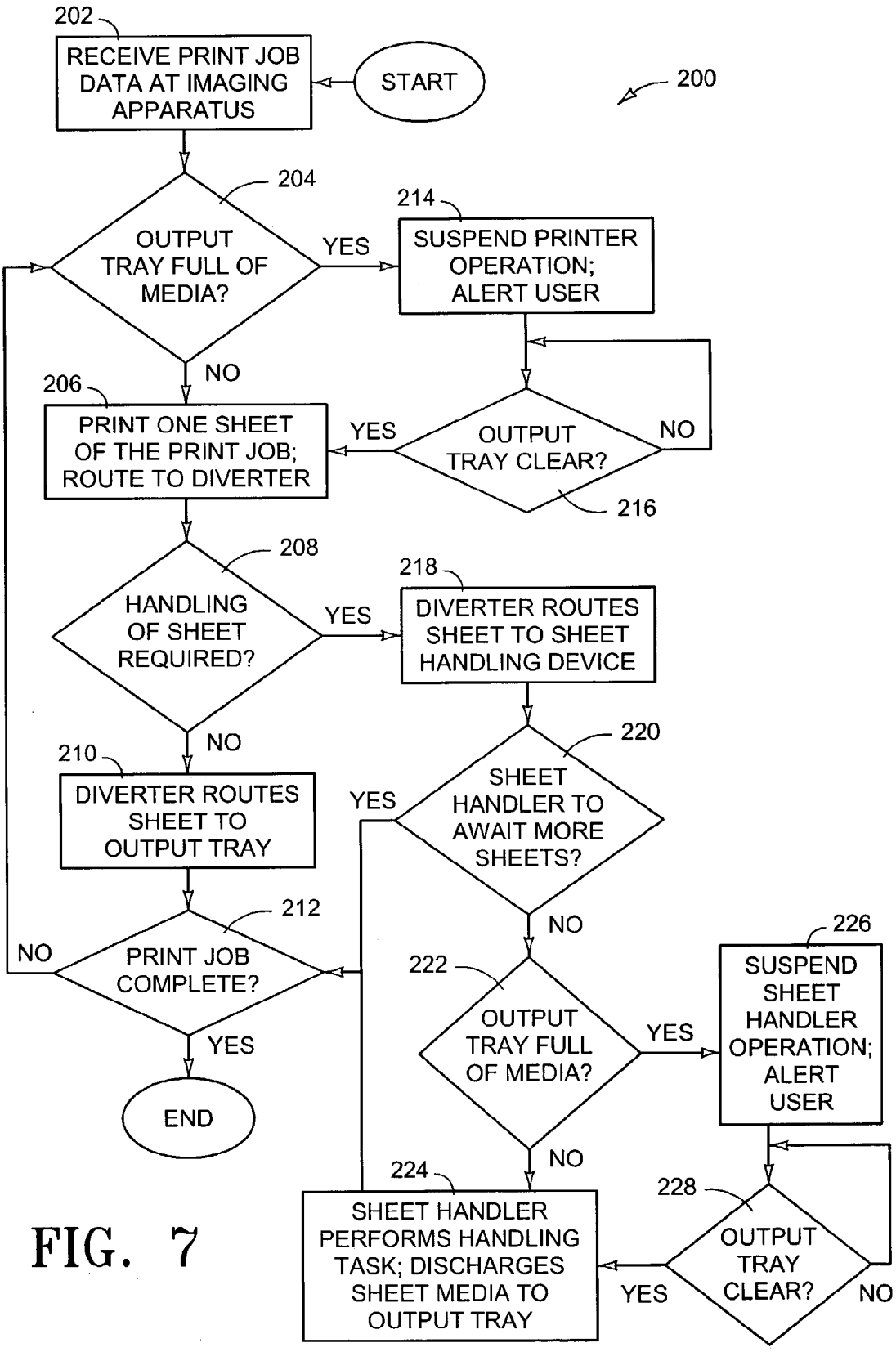
FIG. 7 is a flowchart depicting an operating method in accordance with the embodiment of FIG. 3.

FIG. 7 is a flowchart depicting an operating method (i.e., logic) 200 in accordance with the embodiment of FIG. 3, beginning with step 202.

In step 202, the controller 146 of the unitary imaging apparatus 120 receives print job data from a computer or other source in signal communication therewith. The print job data typically defines a document or documents to be printed (i.e., image formed) onto sheet media, and optionally handled.

In step 204, the controller 146 determines if the output tray 126 is "full" of sheet media 156 and/or 158, via a signal from the level detector 162. If not, then the sequence 200 proceeds to step 206. If so, then the sequence 200 proceeds to step 214.

In step 206, the imaging device 150 prints one sheet of the defined print job and routes it to the diverter 154, under the control of the controller 146.

In step 208, the controller 146 determines if the sheet just printed in step 206 requires handling (e.g., stapling, hole punching, etc.) as defined by the print job data. If not, then the sequence 200 proceeds to step 210. If handling is required, then the sequence 200 proceeds to step 218.

In step 210, the controller 146 instructs the diverter 154 to route and discharge the sheet printed in step 206 to the output tray 126.

In step 212, the controller 146 determines if the print job is yet complete as defined by the print job data. If not, then the sequence 200 proceeds back to the step 204 to continue processing (i.e., printing and optionally handling) the pending print job. If the print job is complete, then the sequence 200 ends.

In step 214, the controller 146 suspends normal operation of the imaging device 150, and optionally alerts a user to the "full" tray condition via the user interface 125 and/or other means, such as, for example, an e-mail message.

In step 216, the controller 146 assumes a wait-loop condition, until the "full" output tray condition last detected in step 204 is cleared. This clearing is typically accomplished by removal of the sheet media 156 and/or 158 from the output tray 126, and/or the receiving of a "resume" instruction via the user interface 125. Once the "full" condition has been cleared and/or reset, the sequence 200 proceeds to step 206.

In step 218, the diverter 154 routes the sheet printed in the last iteration of step 206 onto the sheet handling device 128, as instructed by the controller 146.

In step 220, the controller 146 determines if additional printed sheets must be sent to the sheet-handling device 128 prior to performing one or more handling operations thereon, as defined by the print job data. If not, then the sequence 200 proceeds to step 222. If the handling device 128 must wait for more sheets, then the sequence 200 returns to the step 204 via the step 212. It is assumed that under this latter condition that the print job is, by definition, not yet complete.

In step 222, the controller 146 determines if the output tray 126 is "full" of sheet media 156 and/or 158, via a signal from the level detector 162. If not, then the sequence proceeds to step 224. If the tray is "full" of sheet media 156 and/or 158, then the sequence 200 proceeds to step 226.

In step 224, the controller 146 causes the sheet-handling device 128 to perform one or more handling operations on the printed sheet media 156, as defined by the print job data. The sheet-handling device can use or more of the elements 164-170 previously described in performing the sheet handling operation(s). The sheet-handling device 128 then discharges the handled sheet media 158 into the output tray 126. The sequence 200 then proceeds to step 212.

In step 226, the controller 146 suspends normal operation of the sheet-handling device 128, and optionally alerts a user to the "full" tray condition via the user interface 125 and/or other means (for example, e-mail).

In step 228, the controller 146 assumes a wait-loop condition until such time that the "full" condition of the output tray 126 detected in the last iteration of step 222 is cleared. Such clearing typically occurs by removal of the sheet media 156 and/or 158 from the output tray 126, and/or the receiving of a "resume" instruction via the user interface 125. After the "full" condition is cleared, the sequence 200 proceeds to the step 224.

As just described, FIG. 7 outlines one possible logic sequence (method) for carrying out the present invention. Other methods can also be used, which employ a sheet media level detector in conjunction with a single receiving tray, so as to realize a unitary imaging apparatus that imposes a reduced reach burden upon the user as compared to the prior art. Furthermore, methods of operating unitary imaging apparatus that includes a single output tray receiving sheet media for each of two sources can also be used, without the need for a level detector associated with the output tray. It is to be understood that although the flow chart of FIG. 7 shows a specific order of execution, the order of execution may be different from that which is depicted.

While the above methods and apparatus have been described in language more or less specific as to structural and methodical features, it is to be understood, however, that they are not limited to the specific features shown and described, since the means herein disclosed comprise preferred forms of putting the invention into effect. The methods and apparatus are, therefore, claimed in any of their forms or modifications within the proper scope of the appended claims appropriately interpreted in accordance with the doctrine of equivalents.

We claim:

1. An imaging apparatus, comprising:

an output tray supported by the imaging apparatus, the output tray having a first end and a second opposite end, the tray being configured (1) to receive first sheet media via a first entrance proximiate the first end from an imaging device configured to selectively form images on the first sheet media, and (2) to receive second sheet media via a second entrance proximate the second end from a second source comprising a sheet handling device, wherein the first source and the second source are respectively supported by the imaging apparatus, wherein the sheet handling device comprises at least one of a stapler, a collator, a folder or a hole punch, wherein the sheet handling device overlies the output tray such that at least one of stapling, collating, folding or hole punching is performed over the output tray and wherein the sheet handling device is configured to receive the second sheet media in a direction and is configured to discharge the second sheet media in substantially the same direction.

2. The imaging apparatus of claim 1, and wherein the imaging device is defined by one of a laser printer, an inkjet printer, or a photocopier.

3. The imaging apparatus of claim 1, and wherein the second source is defined by a sheet handling device configured to selectively perform at least one operation on the second sheet media.

4. The imaging apparatus of claim 3, and wherein the sheet handling device includes at least one of a stapler, a collator, a folder, or a hole punch.

5. The imaging apparatus of claim 1, and further comprising a level detector configured to provide a signal in response to detecting a predetermined accumulation of the first sheet media and the second sheet media within the output tray.

6. The imaging apparatus of claim 5, and wherein the imaging apparatus is configured to selectively suspend normal operation of at least one of the first source or the second source in response to the signal.

7. The imaging apparatus of claim 5, and wherein the level detector includes a light source and a light sensor configured such that a beam of light from the light source to the light sensor is substantially blocked by the predetermined cumulative level of the first sheet media and the second sheet media within the output tray during the detecting.

8. The imaging apparatus of claim 1, wherein the second source comprises a sheet handling device and wherein the output tray underlies the sheet handling device.

9. The imaging apparatus of claim 1, wherein the output tray includes a floor and a wall extending nonparallel from the floor at the first end so as to abut edges of sheet media on the floor.

10. The imaging apparatus of claim 9, wherein the first entrance extends over and above the wall.

11. An imaging apparatus, comprising:

an imaging device configured to generate images on sheet media a sheet handling device configured to receive sheet media from the imaging device in a first direction and to discharge the sheet media in substantially the same direction; and an output tray configured to receive sheet media from both of the imaging device and the sheet handling device, wherein the sheet handling device is above and over the output tray, wherein the output tray receives sheet media from the imaging device proximate a first end of the output tray and wherein the output tray receives sheet media from the sheet handling device proximate a second opposite end of the output tray.

12. The imaging apparatus of claim 11, and further comprising a detector configured to provide a signal in response to detecting a predetermined accumulation of the sheet media from the imaging device and the sheet media from the sheet handling device within the output tray.

13. The imaging apparatus of claim 12, and wherein the detector includes a light source and a light sensor, and wherein a light beam from the light source to the light sensor is substantially blocked by the predetermined accumulation of the sheet media from the imaging device and the sheet media from the sheet handling device during the detecting.

14. The imaging apparatus of claim 12, and further comprising a control panel configured to provide an indication in response to the signal.

15. The imaging apparatus of claim 12, and further comprising a controller coupled to the signal and configured to selectively resumably suspend normal operation of the imaging device and the sheet handling device, respectively, in response to the signal.

16. The imaging apparatus of claim 11, wherein the sheet handling device comprises at least one of a stapler, a collator, a folder or a hole punch and wherein the sheet handling device is configure to perform at least one of stapling, collating, folding or hole punching above and over the output tray.

17. A multi-function printer, comprising:

a controller;

an imaging device coupled in control signal communication with the controller and configured to selectively generate images on sheet media;

a sheet handling device coupled in control signal communication with the controller and configured to selectively perform at least one operation on sheet media received from the imaging device, wherein the sheet handling device is configured to receive the sheet media in a first direction and to discharge the sheet media in substantially the same direction;

an output tray configured to receive sheet media from the imaging device and sheet media from the sheet handling device; and a level detector configured to provide a level signal to the controller in response to detecting a predetermined accumulation of the sheet media from the imaging device and the sheet media from the sheet handling device within the output tray, wherein the sheet handling device is above and over the output tray, wherein the output tray receives sheet media from the imaging device proximate a first end of the output tray and wherein the output tray receives sheet media from the sheet handling device proximate a second opposite end of the output tray.

18. The multi-function printer of claim 17, and wherein the controller is configured to selectively resumably suspend normal operation of at least one of the imaging device or the sheet handling device in response to the level signal.

19. The multi-function printer of claim 17, and further comprising a control panel coupled in control signal communication with the controller, and wherein the control panel is configured to provide an indication in response to the level signal.

20. The multi-function printer of claim 17, and wherein the imaging device is defined by one of a laser printer, and inkjet printer, a thermal-imaging printer, or a dot-matrix printer.

21. The multi-function printer of claim 17, and wherein the sheet handling device includes at least one of a stapler, a collator, a folder, or a hole punch.

22. The multi-function printer of claim 17, and wherein the level detector includes a light source and a light sensor, and wherein a beam of light from the light source to the light sensor is substantially blocked by the predetermined accumulation of the sheet media from the imaging device and the sheet media from the sheet handling device within the output tray during the detecting.

23. The multi-function printer of claim 17, wherein the sheet handling device comprises at least one of a stapler, a collator, a folder or a hole punch and wherein the sheet handling device overlies the output tray such that at least one of stapling, collating, folding or hole punching is performed over the output tray.

24. A printer device, comprising:

means for forming images on a first and a second sheet media;

means for receiving the first and second sheet media, the receiving means having a first end and a second opposite end;

means for selectively performing at least one sheet handling operation on the second sheet media and then discharging the second sheet media to the receiving means via a first entrance proximate the first end;

means for selectively diverting the first sheet media from the image forming means to a second entrance proximate the second end of the receiving means and the second sheet media from the image forming means to the sheet handling means; and means for providing a level signal in correspondence to a predetermined accumulation of the first and second sheet media within the receiving means, wherein the means for performing at least one sheet handling operation is above and over the receiving means, wherein the sheet handling means is configured to receive the second sheet media in a direction and is configured to discharge the second sheet media in substantially the same direction.

25. The printer device of claim 24, and further comprising means for coupling the level signal to the image forming means such that the image forming means selectively suspends normal operation in response to the level signal.

26. The printer device of claim 24, and further comprising means for coupling the level signal to the sheet handling means such that the sheet handling means selectively suspends normal operation in response to the level signal.

27. The printer device of claim 24, wherein the means for receiving includes a floor and a wall extending nonparallel from the floor at the second end so as to abut edges of sheet media on the floor.

28. The printer device of claim 27, wherein the first entrance extends over and above the wall.

* * * * *

UNITED STATES PATENT AND TRADEMARK OFFICE

CERTIFICATE OF CORRECTION

PATENT NO. : 7,275,743 B2
APPLICATION NO. : 10/373818
DATED : October 2, 2007
INVENTOR(S) : Paul K. Mui et al.

It is certified that error appears in the above-identified patent and that said Letters Patent is hereby corrected as shown below:

In column 11, line 13, in Claim 1, delete “proximiate” and insert -- proximate --, therefor.

In column 11, line 67, in Claim 11, after “media” insert -- ; --.

Signed and Sealed this

Twelfth Day of August, 2008

JON W. DUDAS
*Director of the United States Patent and Trademark Office*